US011484805B1

(12) United States Patent
Huxta

(10) Patent No.: US 11,484,805 B1
(45) Date of Patent: Nov. 1, 2022

(54) DOLL AND INTERCHANGEABLE HAT ASSEMBLY

(71) Applicant: Amanda Huxta, Everett, PA (US)

(72) Inventor: Amanda Huxta, Everett, PA (US)

( * ) Notice: Subject to any disclaimer, the term of this patent is extended or adjusted under 35 U.S.C. 154(b) by 0 days.

(21) Appl. No.: 17/234,059

(22) Filed: Apr. 19, 2021

(51) Int. Cl.
*A63H 3/02* (2006.01)
*A63H 3/52* (2022.01)

(52) U.S. Cl.
CPC ..... *A63H 3/52* (2013.01); *A63H 3/02* (2013.01)

(58) Field of Classification Search
CPC ..... A63H 3/52; A63H 3/02
USPC ..... 446/98, 369, 394, 901
See application file for complete search history.

(56) References Cited

U.S. PATENT DOCUMENTS

D255,371 S 6/1980 McAllister
4,414,774 A * 11/1983 Fogarty ..... A63H 3/44 446/98
4,968,281 A * 11/1990 Smith ..... A63H 3/36 446/369
D341,637 S 11/1993 Kennedy
5,746,639 A * 5/1998 Bloom ..... A63H 3/52 446/369
5,749,764 A * 5/1998 Bailey ..... A63H 3/02 446/302
5,803,266 A * 9/1998 Blackwelder ..... A42B 1/24 2/244
6,447,363 B1 * 9/2002 Carraway ..... A47G 33/00 446/72
6,460,193 B1 * 10/2002 Di Palma ..... A42C 5/00 2/209.13
6,612,896 B1 * 9/2003 Choi ..... A63H 3/04 446/369
6,842,911 B2 * 1/2005 Yeh ..... A42B 1/004 2/209.13
D821,256 S 6/2018 Parisi
10,272,348 B2 * 4/2019 Brant ..... A63H 3/02
D884,549 S 5/2020 Luo
2002/0168919 A1 * 11/2002 Perkins ..... A63H 3/005 446/369
2004/0115604 A1 * 6/2004 Dear ..... G09B 19/0038 434/236
2007/0087655 A1 * 4/2007 Rifkin ..... A63H 3/28 446/268
2009/0068920 A1 3/2009 Brielmann
2015/0290545 A1 * 10/2015 Barney ..... A63F 13/21 463/31
2018/0168263 A1 * 6/2018 Powers ..... A42B 1/242

* cited by examiner

*Primary Examiner* — Nini F Legesse

(57) ABSTRACT

A doll and interchangeable hat assembly for celebrating events and entertainment includes a doll, which comprises a body and a head. Each of a plurality of hats is selectively engageable to the doll so that the hat is positioned on and extends from the head of the doll. Each hat has a respective theme so that the plurality of hats comprises hats having a variety of themes. A respective hat having an associated theme is selectively engageable to the doll so that the respective hat acknowledges an event associated with the associated theme.

16 Claims, 5 Drawing Sheets

DOLL AND INTERCHANGEABLE HAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to doll assemblies and more particularly pertains to a new doll assembly for celebrating events and entertainment. The present invention discloses aa doll assembly including a doll and a plurality of themed hats, with the hats being selectively engageable to a head of the doll. Further lacking in the prior art is a plurality of panels, which are variously shaped and configured to be selectively decorated, and which can be selectively engaged to a respective hat engaged to the doll.

(2) Description of Related Art Including Information Disclosed Under 37 CFR 1.97 and 1.98

The prior art relates to doll assemblies. Prior art doll assemblies may comprise dolls to which respective elements, such as a messages, plaques, or the like, can be magnetically attached. What is lacking in the prior art is a doll assembly including a doll and a plurality of themed hats, with the hats being selectively engageable to a head of the doll. Further lacking in the prior art is a plurality of panels, which are variously shaped and configured to be selectively decorated, and which can be selectively engaged to a respective hat engaged to the doll.

BRIEF SUMMARY OF THE INVENTION

An embodiment of the disclosure meets the needs presented above by generally comprising a doll, which comprises a body and a head. Each of a plurality of hats is selectively engageable to the doll so that the hat is positioned on and extends from the head of the doll. Each hat has a respective theme so that the plurality of hats comprises hats having a variety of themes. A respective hat having an associated theme is selectively engageable to the doll, wherein the respective hat is configured to acknowledge an event associated with the associated theme.

The doll assembly also may comprise an instruction providing historical context for the associated events corresponding to the themes of the hats. The instruction also may include a set of rules and guidelines for use by a set of users in interacting with or in playing a game using the doll.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
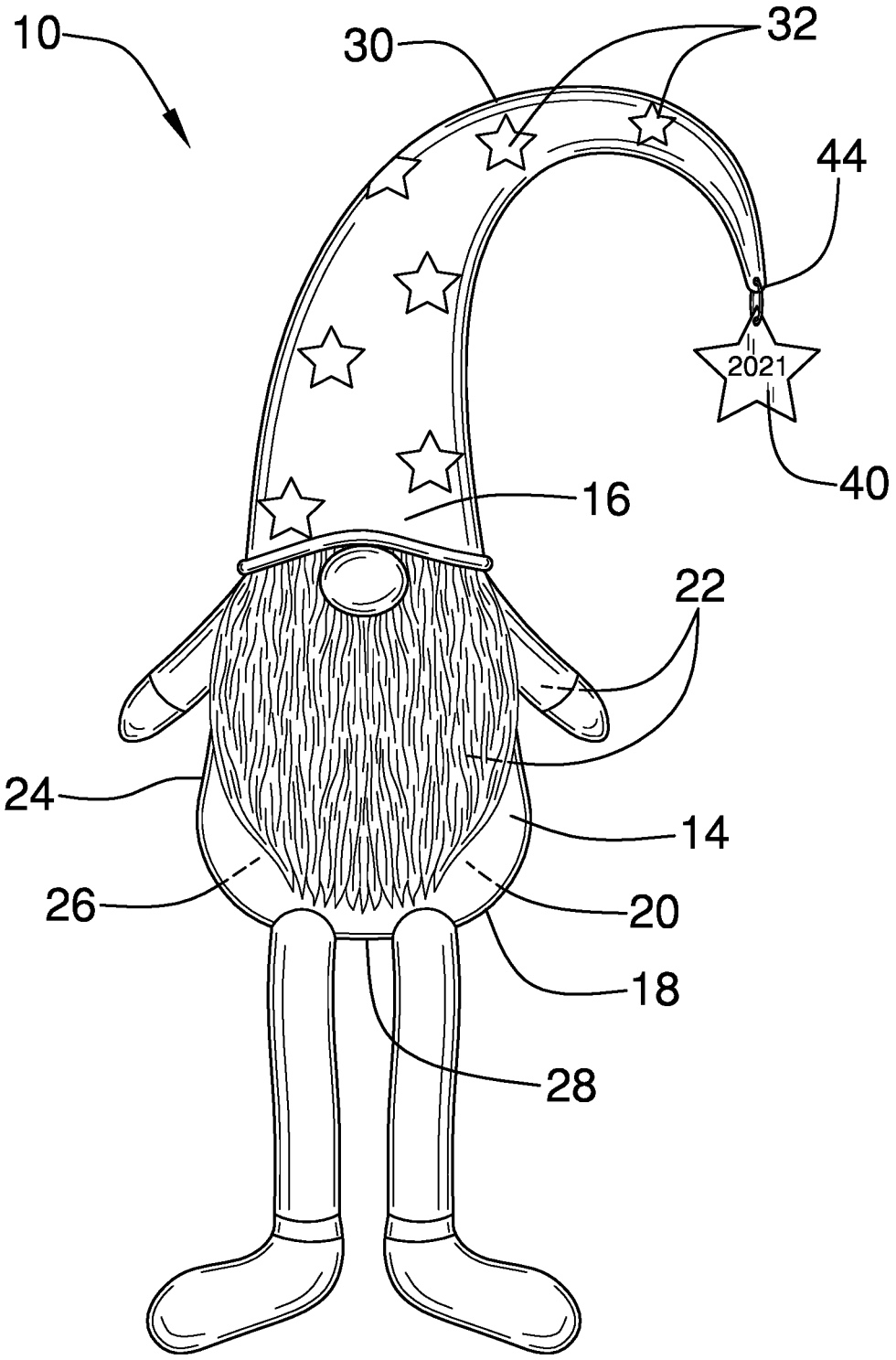
FIG. 1 is a front view of a doll and interchangeable hat assembly according to an embodiment of the disclosure.
Figure 2:
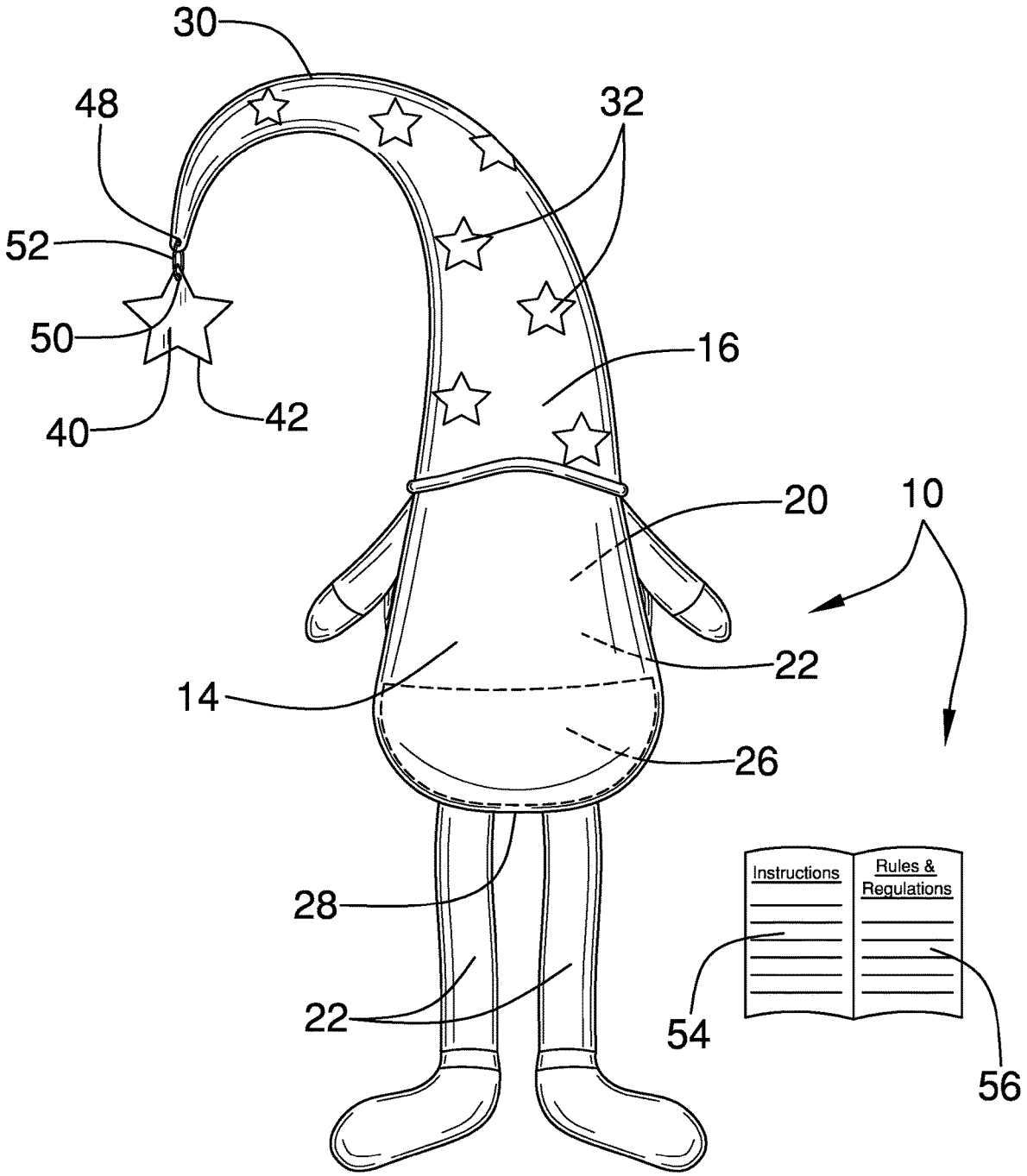
FIG. 2 is a rear view of an embodiment of the disclosure.

With reference now to the drawings, and in particular to FIGS. 1 through 5 thereof, a new doll assembly embodying the principles and concepts of an embodiment of the disclosure and generally designated by the reference numeral 10 will be described.

As best illustrated in FIGS. 1 through 5, the doll and interchangeable hat assembly 10 generally comprises a doll 12, which in turn comprises a body 14 and a head 16. The doll 12 comprises an exterior shell 18. The exterior shell 18 comprises cloth and defines an interior space 20. The interior space 20 is substantially occupied by resiliently compressible stuffing 22 so that the doll 12 is plush. The doll 12 may be configured as a gnome 24, which may be bearded, as shown in FIG. 1. The present invention also anticipates the doll 12 being configured to represent other figures, such as, but not limited to, historical figures, cartoon characters, and the like. A weight 26 is positioned in the body 14, proximate to a lower end 28 of the body 14, so that the doll 12 is biased to a seated position.

Each of a plurality of hats 30 is selectively engageable to the doll 12 so that the hat 30 is positioned on and extends from the head 16 of the doll 12. Each hat 30 has a respective theme 32 so that the plurality of hats 30 comprises hats 30 having a variety of themes 32. A respective hat 30 having an associated theme 32 is selectively engageable to the doll 12, wherein the respective hat 30 is configured to acknowledge an event associated with the associated theme 32.

The plurality of hats 30 may comprise hats 30 for acknowledging one or more of holidays, seasons, birthdays, anniversaries, religious events, political events, secular events, personal events, and the like. The plurality of hats 30 also may comprise hats 30 for acknowledging events recognized by one or more of a respective country, a respective state, a respective cultural group, a respective ethnic group, a respective civic group, a respective family group, and the like.

Figure 3:
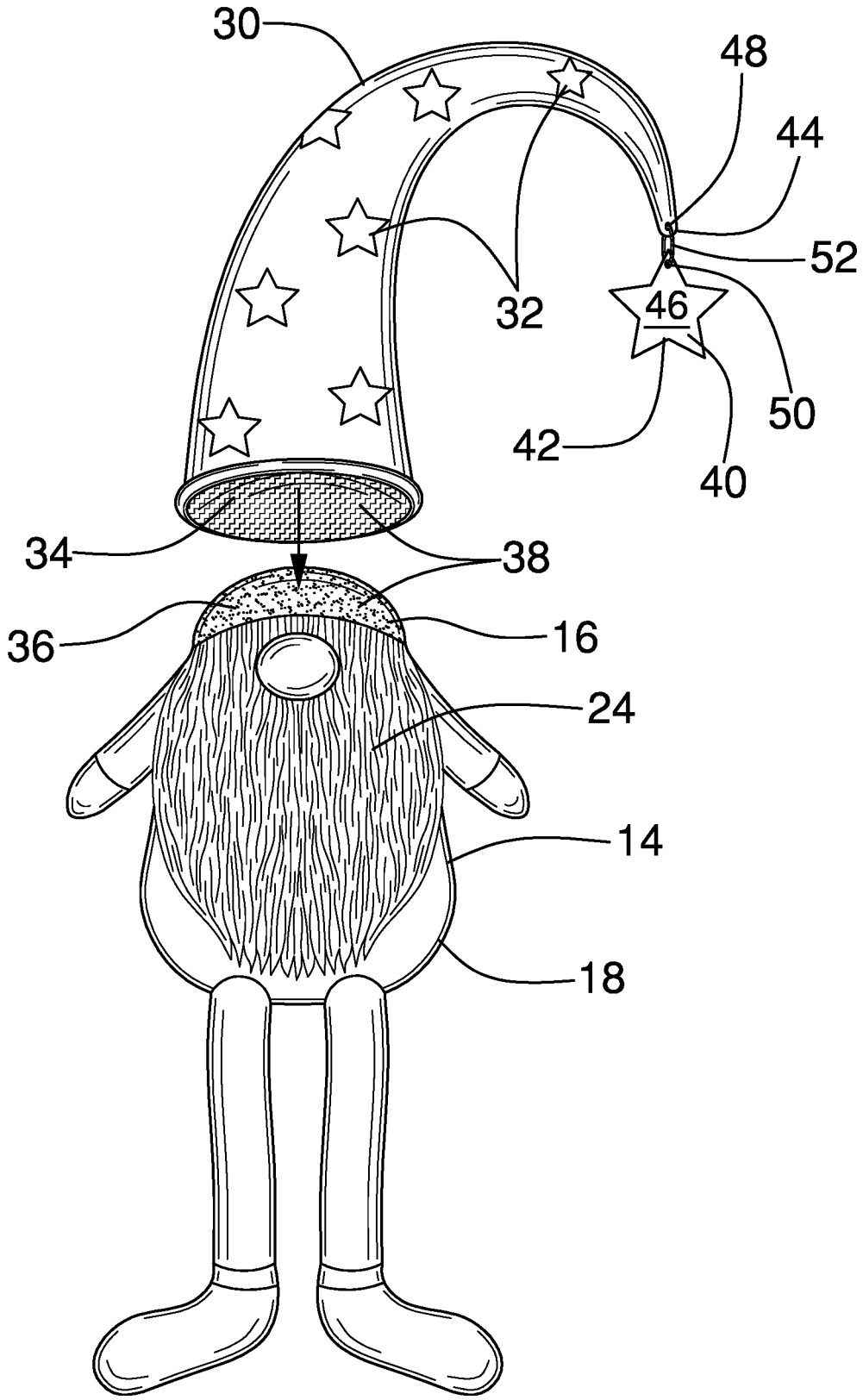
FIG. 3 is an exploded view of an embodiment of the disclosure.

Each hat 30 may be elongated cone shaped, as shown in FIG. 3, or alternatively shaped, such as, but not limited to, top hat shaped, ballcap shaped, sombrero shaped, and the like. A first fastener 34 is engaged to the respective hat 30. A second fastener 36, which is complementary to the first fastener 34, is engaged to the head 16 of the doll 12. The second fastener 36 is positioned to selectively engage the first fastener 34 to removably engage the respective hat 30 to the head 16 of the doll 12. The second fastener 36 and the first fastener 34 may comprise a hook and loop fastener 38, as shown in FIG. 3, or other fastening means, such as, but not limited to, button closures, pressure sensitive adhesives, magnets, and the like.

Figure 4:
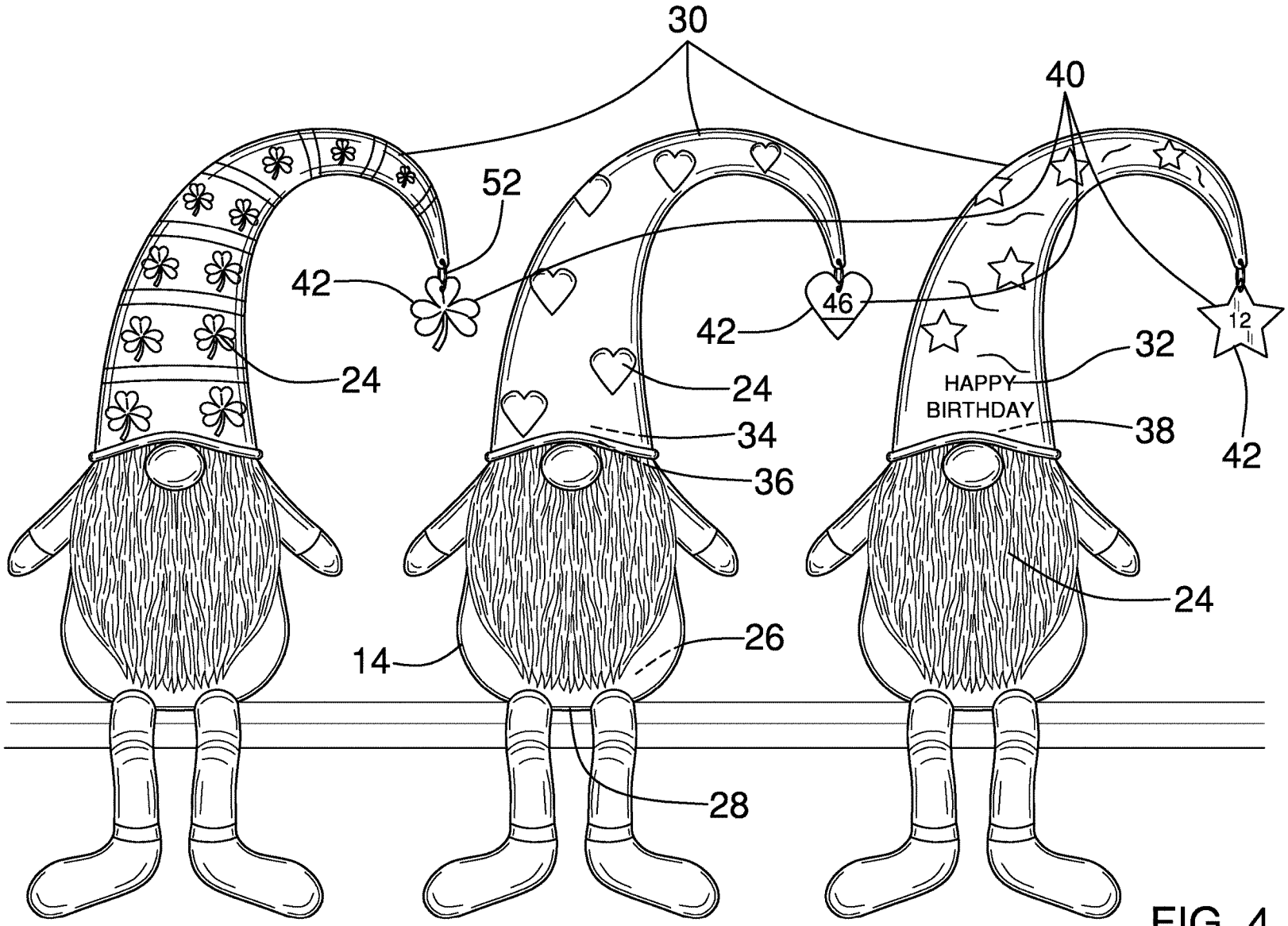
FIG. 4 is a front view of an embodiment of the disclosure.
Figure 5:
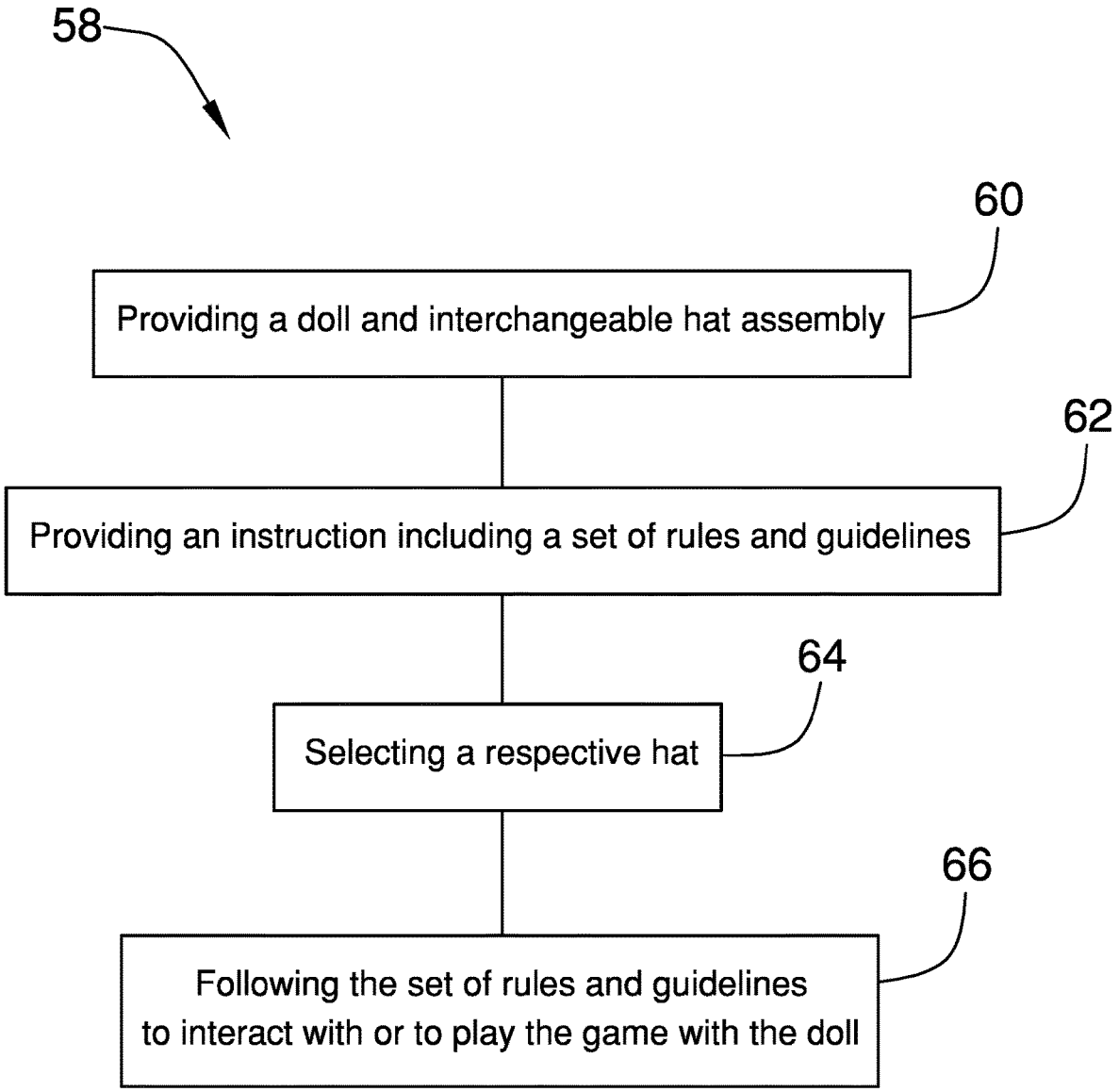
FIG. 5 is a flow diagram for a method utilizing an embodiment of the disclosure.

The assembly 10 also may comprise a plurality of panels 40. Each panel 40 has a respective shape 42 so that the plurality of panels 40 comprises panels 40 having a variety of shapes 42, as is shown in FIG. 4. Each panel 40 is selectively engageable to a respective hat 30 so that the panel 40 is removably engaged to the respective hat 30 proximate to a top 44 of the respective hat 30. The panel 40 has an exterior surface 46, which is smooth and nonporous so that the exterior surface 46 is configured to be marked with erasable ink.

Each of a plurality of first holes 48 is positioned in a respective hat 30 proximate to the top 44. Each of a plurality of second holes 50 is positioned in a respective panel 40. A clip 52 is selectively insertable through a respective second hole 50 and a respective first hole 48 to removably engage a respective panel 40 to a respective hat 30.

The doll and interchangeable hat assembly 10 also may comprise an instruction 54, which provides historical context for the associated events corresponding to the themes 32 of the hats 30. The instruction 54 also may include a set of rules and guidelines 56 for use by a set of users in interacting with or in playing a game using the doll 12. For example, the set of rules and guidelines 56 may provide for naming of the doll 12, rules on touching and positioning of the doll 12, and the like. The instruction 54 may be provided in one or both of hardcopy format and digital format.

In use, the doll and interchangeable hat assembly 10 enables a method 58 of interacting with or playing a game with a doll 12. The method 58 comprises a first step 60 of providing a doll and interchangeable hat assembly 10 according to the specification above. A second step 62 of the method 58 entails providing an instruction 54, including a set of rules and guidelines 56, for use by a set of users in interacting with or in playing a game using the doll 12. A third step 64 of the method 58 is selecting a respective hat 30 and engaging the respective hat 30 to the head 16 of the doll 12. A fourth step 66 of the method 58 is following the set of rules and guidelines 56 to interact with or to play the game with the doll 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A doll and interchangeable hat assembly comprising:

a doll comprising a body and a head;

a plurality of hats, each hat being selectively engageable to the doll such that the hat is positioned on and extends from the head of the doll, each hat having a respective theme such that the plurality of hats comprises hats having a variety of themes, such that a respective hat having an associated theme is selectively engageable to the doll, wherein the respective hat is configured for acknowledging an event associated with the associated theme;

a plurality of panels, each panel having a respective shape, such that the plurality of panels comprises panels having a variety of shapes, each panel being selectively engageable to a respective hat, such that the panel is removably engaged to the respective hat proximate to a top of the respective hat;

a plurality of first holes being positioned in a respective hat proximate to the top;

a plurality of second holes being positioned in a respective panel; and a clip selectively insertable through a respective second hole and a respective first hole for removably engaging a respective panel to a respective hat.

2. The doll and interchangeable hat assembly of claim 1, wherein the doll comprises an exterior shell, the exterior shell comprising cloth and defining an interior space, the interior space being substantially occupied by resiliently compressible stuffing such that the doll is plush.

3. The doll and interchangeable hat assembly of claim 1, wherein the doll is configured as a gnome.

4. The doll and interchangeable hat assembly of claim 3, wherein the doll is configured as a bearded gnome.

5. The doll and interchangeable hat assembly of claim 1, further including a weight positioned in the body proximate to a lower end of the body, such that the doll is biased to a seated position.

6. The doll and interchangeable hat assembly of claim 1, wherein each hat is elongated cone shaped.

7. The doll and interchangeable hat assembly of claim 1, wherein the plurality of hats comprises hats for acknowledging one or more of holidays, seasons, birthdays, anniversaries, religious events, political events, secular events, and personal events.

8. The doll and interchangeable hat assembly of claim 1, wherein the plurality of hats comprises hats for acknowledging events recognized by one or more of a respective country, a respective state, a respective cultural group, a respective ethnic group, a respective civic group, or a respective family group.

9. The doll and interchangeable hat assembly of claim 1, wherein the panel has an exterior surface, the exterior surface being smooth and nonporous, such that the exterior surface is configured for being marked with erasable ink.

10. The doll and interchangeable hat assembly of claim 1, further including an instruction providing historical context for the associated events corresponding to the themes of the hats.

11. The doll and interchangeable hat assembly of claim 10, further including the instruction including a set of rules and guidelines for use by a set of users in interacting with or in playing a game using the doll.

12. The doll and interchangeable hat assembly of claim 10, wherein the instruction is provided in one or both of hardcopy format and digital format.

13. The doll and interchangeable hat assembly of claim 1, further including:

a first fastener engaged to the respective hat; and a second fastener engaged to the head of the doll, the second fastener being complementary to the first fastener, such that the second fastener is positioned for selectively engaging the first fastener for removably engaging the respective hat to the head of the doll.

14. The doll and interchangeable hat assembly of claim 13, wherein the second fastener and the first fastener comprise a hook and loop fastener.

15. A method of interacting with or playing a game with a doll and interchangeable hat assembly, the method comprising the steps of:

providing a doll and interchangeable hat assembly comprising:

a doll comprising a body and a head, and a plurality of hats, each hat being selectively engageable to the doll such that the hat is positioned on and extends from the head of the doll, each hat having a respective theme such that the plurality of hats comprises hats having a variety of themes, such that a respective hat having an associated theme is selectively engageable to the doll, wherein the respective hat is configured for acknowledging an event associated with the associated theme, a plurality of panels, each panel having a respective shape, such that the plurality of panels comprises panels having a variety of shapes, each panel being selectively engageable to a respective hat, such that the panel is removably engaged to the respective hat proximate to a top of the respective hat, a plurality of first holes being positioned in a respective hat proximate to the top, a plurality of second holes being positioned in a respective panel, a clip selectively insertable through a respective second hole and a respective first hole for removably engaging a respective panel to a respective hat;

providing an instruction including a set of rules and guidelines for use by a set of users in interacting with or in playing a game using the doll;

selecting a respective hat and engaging the respective hat to the head of the doll; and following the set of rules and guidelines to interact with or to play the game with the doll.

16. A doll and interchangeable hat assembly comprising:

a doll comprising a body and a head, the doll comprising an exterior shell, the exterior shell comprising cloth and defining an interior space, the interior space being substantially occupied by resiliently compressible stuffing such that the doll is plush, the doll being configured as a gnome, the doll being configured as a bearded gnome;

a weight positioned in the body proximate to a lower end of the body, such that the doll is biased to a seated position;

a plurality of hats, each hat being selectively engageable to the doll such that the hat is positioned on and extends from the head of the doll, each hat having a respective theme such that the plurality of hats comprises hats having a variety of themes, such that a respective hat having an associated theme is selectively engageable to the doll, wherein the respective hat is configured for acknowledging an event associated with the associated theme, each hat being elongated cone shaped, the plurality of hats comprising hats for acknowledging one or more of holidays, seasons, birthdays, anniversaries, religious events, political events, secular events, and personal events, the plurality of hats comprising hats for acknowledging events recognized by one or more of a respective country, a respective state, a respective cultural group, a respective ethnic group, a respective civic group, or a respective family group;

a first fastener engaged to the respective hat;

a second fastener engaged to the head of the doll, the second fastener being complementary to the first fastener, such that the second fastener is positioned for selectively engaging the first fastener for removably engaging the respective hat to the head of the doll, the second fastener and the first fastener comprising a hook and loop fastener;

a plurality of panels, each panel having a respective shape, such that the plurality of panels comprises panels having a variety of shapes, each panel being selectively engageable to a respective hat, such that the panel is removably engaged to the respective hat proximate to a top of the respective hat, the panel having an exterior surface, the exterior surface being smooth and nonporous, such that the exterior surface is configured for being marked with erasable ink;

a plurality of first holes being positioned in a respective hat proximate to the top;

a plurality of second holes being positioned in a respective panel;

a clip selectively insertable through a respective second hole and a respective first hole for removably engaging a respective panel to a respective hat; and an instruction providing historical context for the associated events corresponding to the themes of the hats, the instruction including a set of rules and guidelines for use by a set of users in interacting with or in playing a game using the doll, the instruction being provided in one or both of hardcopy format and digital format.

* * * * *